US010273749B2

(12) United States Patent
Lei et al.

(10) Patent No.: US 10,273,749 B2
(45) Date of Patent: Apr. 30, 2019

(54) CORD WINDING MECHANISM FOR A CORDLESS WINDOW BLIND

(71) Applicants: Zhenbang Lei, Guangdong Province (CN); Xinbang Lei, Guangdong Province (CN)

(72) Inventors: Zhenbang Lei, Guangdong Province (CN); Xinbang Lei, Guangdong Province (CN)

( * ) Notice: Subject to any disclaimer, the term of this patent is extended or adjusted under 35 U.S.C. 154(b) by 456 days.

(21) Appl. No.: 15/001,199

(22) Filed: Jan. 19, 2016

(65) Prior Publication Data

US 2017/0145743 A1 May 25, 2017

(30) Foreign Application Priority Data

Nov. 24, 2015 (CN) ..... 2015 1 0828195

(51) Int. Cl.

| | |
|---|---|
| ***E06B 9/322*** | (2006.01) |
| ***E06B 9/36*** | (2006.01) |
| ***B65H 75/26*** | (2006.01) |
| ***B65H 75/44*** | (2006.01) |
| ***E06B 9/24*** | (2006.01) |
| ***E06B 9/26*** | (2006.01) |
| ***E06B 9/382*** | (2006.01) |

(52) U.S. Cl.

CPC ..... *E06B 9/368* (2013.01); *B65H 75/26* (2013.01); *B65H 75/4415* (2013.01); *E06B 9/24* (2013.01); *E06B 9/26* (2013.01); *E06B 9/322* (2013.01); *E06B 9/382* (2013.01); *B65H 2701/35* (2013.01); *E06B 2009/3222* (2013.01)

(58) Field of Classification Search

CPC .... E06B 9/368; E06B 2009/3222; E06B 9/32; E06B 9/322; B65H 75/26; B65H 75/4415; B65H 2701/35

See application file for complete search history.

(56) References Cited

U.S. PATENT DOCUMENTS

| | | | | |
|---|---|---|---|---|
| 9,314,125 | B2 * | 4/2016 | Anthony | A47H 5/032 |
| 2006/0169422 | A1 * | 8/2006 | Cheng | E06B 9/322 160/170 |
| 2007/0251101 | A1 * | 11/2007 | Shibasaki | A01D 34/4162 30/276 |
| 2010/0206492 | A1 * | 8/2010 | Shevick | E06B 9/30 160/170 |
| 2013/0032300 | A1 * | 2/2013 | Yu | E06B 9/322 160/84.02 |
| 2013/0299102 | A1 * | 11/2013 | Anthony | E06B 9/262 160/321 |
| 2015/0275573 | A1 * | 10/2015 | Huang | E06B 9/322 160/192 |
| 2016/0123447 | A1 * | 5/2016 | Chen | F16H 31/001 160/168.1 P |

* cited by examiner

*Primary Examiner* — Daniel P Cahn

(57) ABSTRACT

A cord winding mechanism for a blind cord with a first end fixed to a window blind includes a base, a cord winder rotatably mounted to the base, a cord guiding assembly mounted to the base, and an elastic press member mounted to the base. The cord winder defines an annular slot to wind the blind cord layer by layer. The cord guiding assembly is abutted against an unwound portion of the blind cord between the cord winder and the window blind. A second end of the blind cord is fixed to an end of the cord winder in the slot. The press member is elastically abutted against a portion of the blind cord just separate from the cord winder.

4 Claims, 3 Drawing Sheets

CORD WINDING MECHANISM FOR A CORDLESS WINDOW BLIND

BACKGROUND OF THE INVENTION

The present invention relates to window blinds and, more particularly to a cord winding mechanism for a cordless window blind.

A cordless window blind is operable to raise and lower slats through elastic devices, without manually operating blind cords. Common cordless window blinds include shutters, honeycomb blinds, and Roman blinds. The cordless window blinds hide blind cords inside the blinds, and install winders on tops of the blinds to collect the blind cords, thus winding or unwinding the blind cords to raise or lower the blinds.

FIG. 6 shows a conventional H-shaped winder 80. A blind cord 5 is wound round the winder 80 in a slot 82 of the winder 80. The H-shaped winder 80 generally operates in one of two operation modes, one of which is randomly winding blind cords and the other of which is adding a complicated cord guiding mechanism. When randomly winding blind cords, the blind cord 5 is wound without guide, thereby, the blind cord 5 is easily disorderly wound round the winder 80. A window blind using two winders 80 and operating in the mode of randomly winding cords easily leans to one side when the two winders 80 rotate the same number of turns while the lengths of the wound blind cords of the two winders 80 are different. When adding a complicated cord guiding mechanism, and when the winder 80 rotates a turn, the cord guiding mechanism moves a distance of a diameter of the blind cord 5. Therefore, the lengths of the wound blind cords of two winders 80 operating in the mode of adding a complicated cord guiding mechanism are the same, and a window blind using the two winders 80 operating in the mode of adding a complicated cord guiding mechanism will not lean to one side. However, the cord guiding mechanism is complicated and costly, and is easily damaged.

FIG. 7 shows another conventional winder 90. The winder 90 defines a helical slot 92 in a circumference of the winder 90. A blind cord 5 is orderly wound in the helical slot 92. However, the winder 90 generally has a large volume, and thus, the winder 90 cannot be used on mini-blinds.

BRIEF SUMMARY OF THE INVENTION

Therefore, a cord winding mechanism is provided, which orderly wind blind cords and assure same wound lengths of the blind cords of different winders controlled by the cord winding mechanism.

According to the present invention, a cord winding mechanism for a blind cord with a first end fixed to a window blind includes a base, a cord winder rotatably mounted to the base, a cord guiding assembly mounted to the base, and an elastic press member mounted to the base. The cord winder defines an annular slot in a circumference therein to wind the blind cord on a circumference of the cord winder in the slot layer by layer. The cord guiding assembly is abutted against an unwound portion of the blind cord between the cord winder and the window blind. A second end of the blind cord is fixed to an end of the circumference of the cord winder in the slot. The press member is elastically abutted against a portion of the blind cord just separate from the cord winder.

Other objects, advantages, and novel features of the invention will become more apparent from the following detailed description when taken in conjunction with the accompanying drawings.

DETAILED DESCRIPTION OF THE INVENTION

Figure 1:
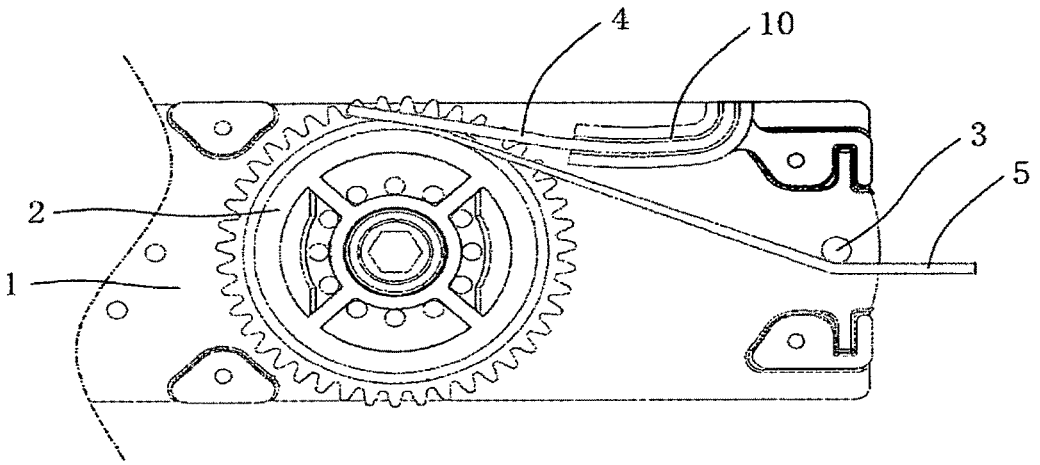
FIG. 1 is a cross-sectional view of a cord winding mechanism for a cordless window blind of a first embodiment of the present invention.

Referring to FIG. 1, a first embodiment of a cord winding mechanism for a cordless window blind includes a base 1, a cord winder 2, a cord guiding assembly, and an elastic press member 4. The cordless window blind is fixed with a blind cord 5.

The base 1 is plate-shaped. The cord winder 2 is rotatably mounted to a side surface of the base 1. The base 1 defines a substantially L-shaped groove 10. A first part of the groove 10 extends toward a side of the base 1, and a second part of the groove 10 extends from a bottom end of the first part of the groove 10 and toward the cord winder 2. The cord winder 2 is substantially H-shaped, and defines an annular slot 20 (same to the slot 20 labeled in FIG. 5) in a circumference of the cord winder 2.

In the first embodiment, the cord guiding assembly includes a guiding wheel 32 rotatably mounted to the side surface of the base 1. An axis of the guiding wheel 32 is parallel to an axis of the cord winder 2. The elastic press member 4 is substantially L-shaped. A first part of the press member 4 is mounted in the first part of the groove 10, and a second part of the press member 4 extends from a bottom end of the first part of the press member 4 and received in the second part of the groove 10. A distal end of the second part of the press member 4 is elastic and cantilevered. A width of the distal end of the press member 4 is substantially equal to a length of the slot 20 in an axial direction of the cord winder 2.

In use, a first end of the blind cord 5 is fixed to the cord winder 2 in the slot 20 and adjacent to an end surface 22 (same to the end surface 22 labeled in FIG. 5) of the cord winder 2 facing the slot 20. The blind cord 5 can be wound on a circumference of the cord winder 2 in the slot 20, with the rotation of the cord winder 2. An unwound portion of the blind cord 5 extends away from the cord winder 2. The distal end of the press member 4 is elastically abutted against a portion of the unwound blind cord 5 just separate from the cord winder 2 toward the axis of the cord winder 2. When the blind cord 5 is not wound on the circumference of the cord winder 2 for a layer, the blind cord 5 is separate from the circumference of cord winder 2 from a position where the unwound blind cord 5 is just separate from and tangent to the circumference of the cord winder 2. Therefore, when the cord winder 2 is rotated to wind the blind cord 5 on the circumference of the cord winder 2 in the slot 20, the press member 4 restricts the blind cord 5 to be orderly wound on the circumference of the cord winder 2 in the slot 20 from the end surface 22 to an opposite end surface 24 (same to the end surface 24 labeled in FIG. 5) of the cord winder 2 facing the slot 20. When the blind cord 5 is wound on the circumference of the cord winder 2 in the slot 20 to form a layer covering the whole circumference of the cord winder 2 in the slot 20, the blind cord 5 will wound on the layer from the opposite end surface 24 toward the end surface 22 for another layer after the blind cord 5 touches the opposite end surface 24. Therefore, the blind cord 5 can be wound on the circumference of the cord winder 2 in the slot 20 layer by layer. When the blind cord 5 is wound on the circumference of the cord winder 2 in the slot for at least one layer, the blind cord 5 is separate from an outmost layer of the wound blind cord 5 from a position where the unwound blind cord 5 is tangent to the outmost layer of the wound blind cord 5. In the embodiment, a surface of the press member 4 facing the cord winder 2 is coated with a layer of flexible material, assuring the press member 4 to be better abutted against the blind cord 5.

The unwound portion of the blind cord 5 extends down and toward the guiding wheel 32, and is slidably abutted against a bottom of a circumference of the guiding wheel 32. The unwound portion of the blind cord 5 is pulled tightly by the cord guiding assembly. A second end of the blind cord 5 is fixed to blind slats (not shown) of the window blind.

Figure 2:
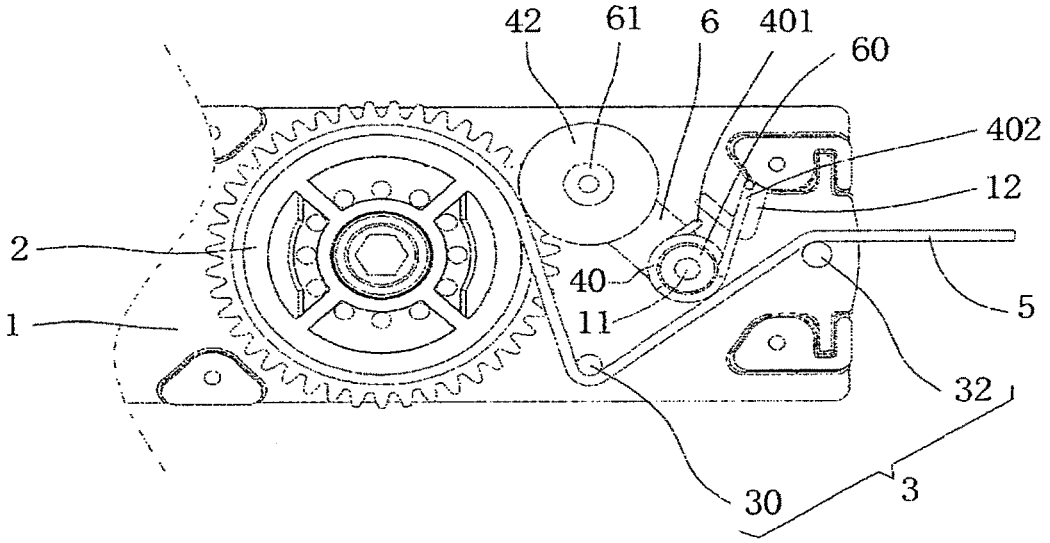
FIG. 2 is a cross-sectional view of a cord winding mechanism for a cordless window blind of a second embodiment of the present invention.

Referring to FIG. 2, a second embodiment of a cord winding mechanism for a cordless window blind is substantially similar to the cord winding mechanism of the first embodiment. In the second embodiment, the cord guiding assembly 3 further includes a guiding pole 30 fixed to the base 1, and located between the cord winder 2 and the guiding wheel 32 and lower than the guiding pole 30. The unwound portion of the blind cord 5 is abutted against a bottom of a circumference of the guiding pole 30 and then is slidably abutted against a top of the circumference of the guiding wheel 32. In another embodiment, the cord guiding assembly 3 only includes the guiding pole 30. In the second embodiment, the base 1 forms a shaft 11 and a block 12. The elastic press member 4 includes a torsion spring 40, a swing arm 6, and a roller 42. Two shafts 60 and 61 extend from opposite ends of the swing arm 6. The shaft 60 is hollow and rotatably fitted about the shaft 11, to rotatably mount the swing arm 6 to the base 1. The torsion spring 40 is fitted about the shaft 60, with a first leg 401 of the torsion spring 40 abutted against the swing arm 6, and a second leg 402 of the torsion spring 40 abutted against the block 12. The first leg 401 and the second leg 402 are located at a same side of the torsion spring 40. The roller 42 is rotatably mounted to the shaft 61 of the swing arm 6, thereby, the first leg 401 and an axis of the roller 42 is relatively fixed. In the second embodiment, the roller 42 replaces the cantilevered distal end of the fixing member 4 of the first embodiment. The roller 42 has a width substantially equal to the length of the slot 20, and a circumference of the roller 42 is coated with a layer of flexible material. The torsion spring 40 biases the swing arm 6 to rotate toward the cord winder 2.

Figure 3:
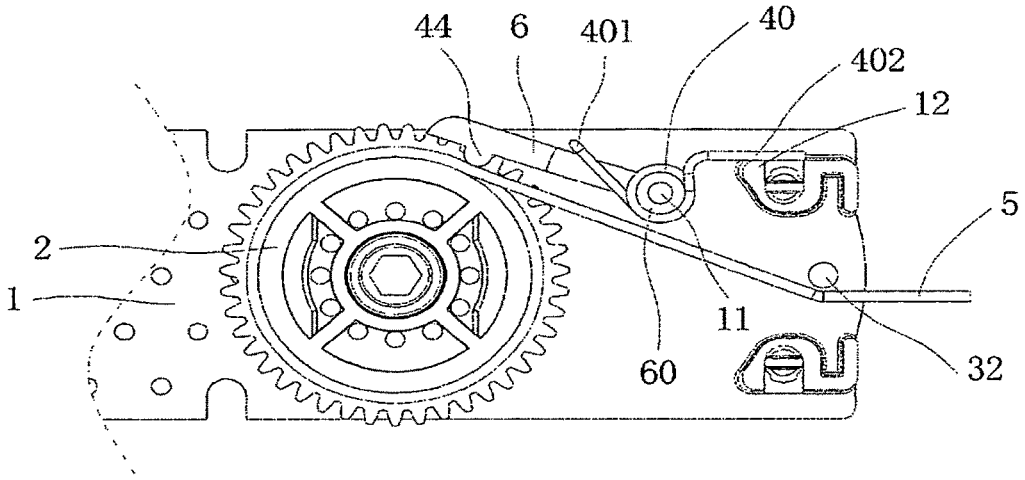
FIG. 3 is a cross-sectional view of a cord winding mechanism for a cordless window blind of a third embodiment of the present invention.

Referring to FIG. 3, a third embodiment of a cord winding mechanism for a cordless window blind is substantially similar to the cord winding mechanism of the first embodiment. In the third embodiment, the base 1 forms a shaft 11 and a block 12. The elastic press member 4 includes a torsion spring 40, a swing arm 6, and a protrusion 44. A hollow shaft 60 extends from a first end of the swing arm 6, and is rotatably fitted about the shaft 11, to rotatably mount the swing arm 6 to the base 1. The torsion spring 40 is fitted about the shaft 60, with a first leg 401 of the torsion spring 40 abutted against the swing arm 6, and a second leg 402 of the torsion spring 40 abutted against the block 12. The protrusion 44 protrudes from a cantilevered second end of the swing arm 6, and includes an arced surface 440 facing the cord winder 2 and replacing the cantilevered distal end of the fixing member 4 of the first embodiment. The protrusion 44 is fixed relative to the first leg 401 of the torsion spring 40. In the third embodiment, the arced surface 440 of the protrusion 44 has a width substantially equal to the length of the slot 20, and is coated with a layer of flexible material. The torsion spring 40 biases the swing arm 6 to rotate toward the cord winder 2.

Figure 4:
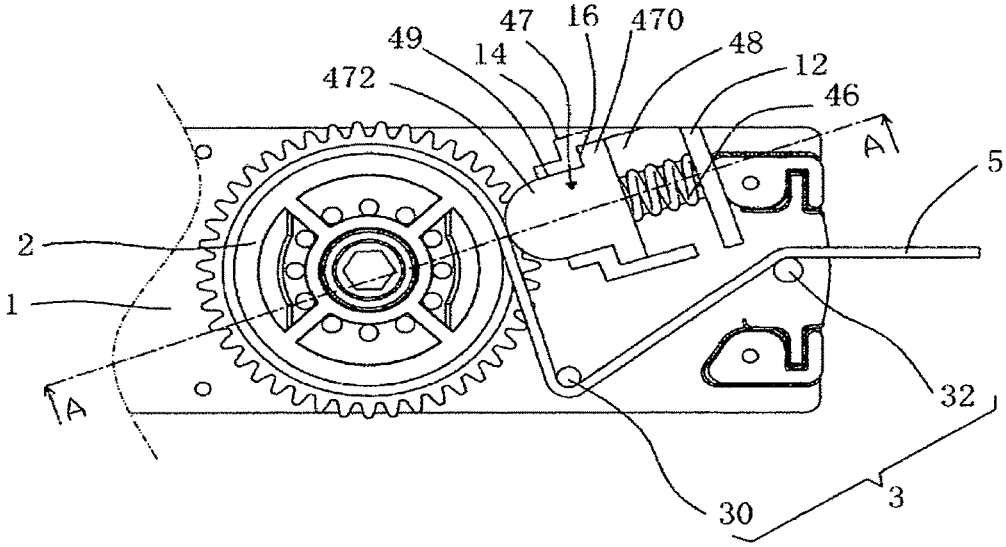
FIG. 4 is a cross-sectional view of a cord winding mechanism for a cordless window blind of a fourth embodiment of the present invention.
Figure 5:
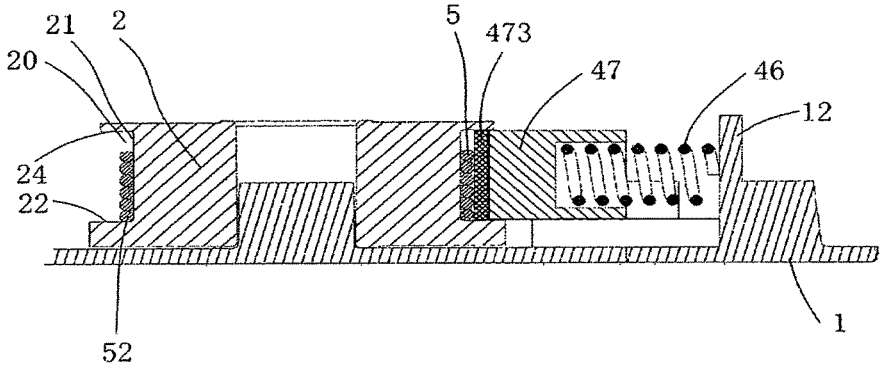
FIG. 5 is a cross-sectional view of FIG. 4, taken along the line of A-A.
Figure 6:
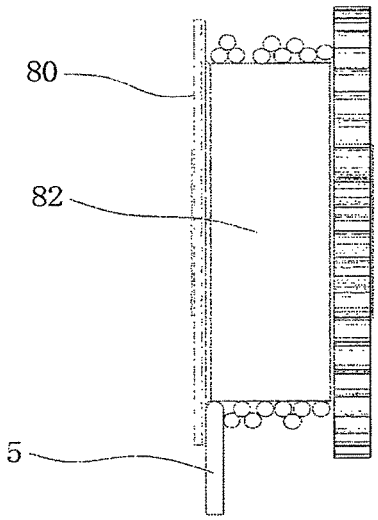
FIG.6 (RELATED ART)
FIG. 6 is a cross-sectional view of a cord winder of a related art.
Figure 7:
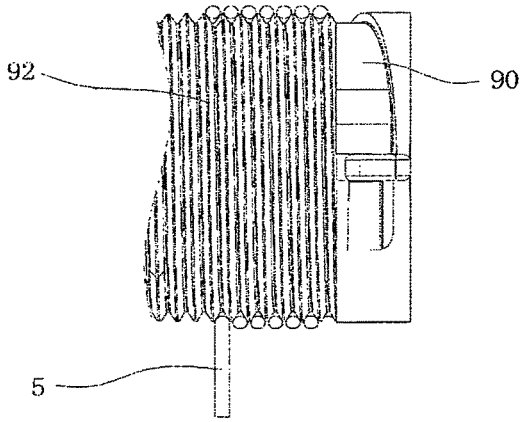
FIG.7 (RELATED ART)
FIG. 7 is a cross-sectional view of a cord winder of another related art.

Referring to FIG. 4 and FIG. 5, a fourth embodiment of a cord winding mechanism for a cordless window blind is substantially similar to the cord winding mechanism of the second embodiment. In the fourth embodiment, the base 1 forms a block 12 and an accommodation member 14 between the block 12 and the cord winder 2. The accommodation member 14 defines an accommodation space 48 open to the block 12, and a through hole 49 extending through an end of the accommodation member 14 facing the cord winder 2 and communicating with the accommodation space 48. The accommodation member 14 forms a shoulder portion 16 between the accommodation space 48 and the through hole 49. The press member 4 includes a compression spring 46 and a rod 47. The rod 47 includes a blocking portion 470 slidably received in the accommodation space 48 and capable of being blocked by the shoulder portion 16, and a protrusion 472 slidably received in the through hole 49 and extending out of an end of the through hole 49 facing the cord winder 2. A first end of the compression spring 46 is fixed to the block 12, and a second end of the compression spring 46 is fixed to the blocking portion 470. A distal end of the protrusion 472 facing the cord winder 2 forms an arced surface replacing the cantilevered distal end of the fixing member 4 of the second embodiment. The protrusion 472 has a width substantially equal to the length of the slot 20, and the arced surface of the protrusion 472 is coated with a layer of flexible material 473. The compression spring 46 biases the rod 47 to slide toward the cord winder 2.

In the invention, an end 52 of the blind cord 5 is fixed to an end of a bottom wall 21 of the slot 20 adjacent to an end surface 22 of the slot 20. The press member 4 is elastically abutted against the blind cord 5 toward the axis of the cord winder 2 at a position. If the blind cord 5 wound on the bottom wall 21 of the slot 20 reaches at least one layer, the position where the unwound blind cord 5 is separate from contact with the outmost layer of the wound blind cord 5 is located at the tangent portion between the outmost layer of the wound blind cord 5 and the unwound blind cord 5. If the blind cord 5 wound on the bottom wall 21 of the slot 20 does not reach a whole layer, the position where the unwound blind cord 5 is separate from contact with the bottom wall 21 of the slot 20 is located at the tangent portion between the the bottom wall 21 of the slot 20 and the unwound blind cord 5. In winding the blind cord 5, the press member 4 continuously applies force on the blind cord 5 at the tangent portion, preventing the blind cord 5 at the tangent portion from producing displacement. Therefore, the blind cord 5 is orderly wound on the bottom wall 21 of the slot 20 closely and layer by layer, with the rotation of the cord winder 2, as shown in FIG. 5. After the blind cord 5 is wound a whole layer from one end surface 22 to the other end surface 24 of the slot 20, the blind cord 5 touches the other end surface 24 of the slot 20, and the blind cord 5 overcomes the elasticity of the press member 4 to be reversely wound for another layer at an outer side and neighboring the fore-layer from the other end surface 24 toward the end surface 22. The blind cord 5 can be wound layer by layer, until the blind cord 5 is wholly wound to completely raise the window blind. Therefore, when there are two or more cord winders 2 controlled by a same cord winding device are mounted to the window blind, the lengths of the wound blind cords 5 wound by the two or more cord winders 2 are substantially same, preventing the window blind from leaning. The cord winding mechanism of the invention has characteristics of simple structure, high reliability, and low cost, and has a high value on quality improvement of window blinds.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A cord winding mechanism, comprising:

a blind cord;

a base;

a cord winder rotatably mounted to the base, and defining an annular slot in a circumference therein to wind the blind cord on a bottom wall of the slot layer by layer;

a cord guiding assembly mounted to the base and abutted against an unwound portion of the blind cord; and an elastic press member mounted to the base;

wherein a second end of the blind cord is fixed to an end of the bottom wall of the slot adjacent to an end surface of the slot, the press member is elastically abutted against a portion of the blind cord just separate from the cord winder; and the base forms an accommodation member defining an accommodation space for receiving the press member, the press member comprises a compression spring with a first end of the compression spring fixed to the base, and a rod fixed to a second end of the compression spring, the rod comprises a protrusion extending out of the accommodation space, the compression spring biases the protrusion to be abutted against the portion of the blind cord just separate from the cord winder.

2. The cord winding mechanism according to claim 1, wherein the protrusion forms an arced surface facing the cord winder, a width of the arced surface is substantially equal to a length of the slot.

3. The cord winding mechanism according to claim 1, wherein the portion of the blind cord just separate from the cord winder is located at a first position where the unwound blind cord is tangent to the bottom wall of the slot, or at a second position where the unwound blind cord is tangent to an outmost layer of a wound portion of the blind cord wound on the bottom wall of the slot in response to the wound portion reaching at least one layer, the press member is abutted against the blind cord toward an axis of the cord winder.

4. The cord winding mechanism according to claim 1, wherein the press member is coated with a layer of flexible material facing the blind cord.

* * * * *